United States Patent [19]

Thiel

[11] 4,161,712

[45] Jul. 17, 1979

[54] CURRENT LIMITING FUSE FOR CAPACITOR

[75] Inventor: Peter H. Thiel, Bloomington, Ind.

[73] Assignee: Westinghouse Electric Corp., Pittsburgh, Pa.

[21] Appl. No.: 787,134

[22] Filed: Apr. 13, 1977

[51] Int. Cl.[2] ..... H01H 85/04

[52] U.S. Cl. ..... 337/159; 337/295

[58] Field of Search ..... 337/159, 187, 276, 290, 337/295, 168, 169, 170, 171, 172, 173, 248, 274, 282, 283

[56] References Cited

U.S. PATENT DOCUMENTS

| | | | |
|---|---|---|---|
| 3,242,291 | 3/1966 | Frink | 337/282 X |
| 3,783,342 | 1/1974 | Thiel et al. | 337/282 X |
| 3,893,056 | 7/1975 | Harner | 337/162 X |
| 4,011,537 | 3/1977 | Jackson et al. | 337/171 |
| 4,020,441 | 4/1977 | Jacobs | 337/159 X |

*Primary Examiner*—George Harris

*Attorney, Agent, or Firm*—Robert E. Converse, Jr.

[57] ABSTRACT

A wide-range current limiting fuse assembly particularly adapted to protect capacitors. The device comprises a current limiting portion having a corrugated fusible ribbon for high fault current protection, and a low current portion having a fusible link surrounded end to end by a conductive metal sleeve connected to one terminal of the fusible link. The current limiting portion may, alternatively, be provided with a circularly cross sectioned fusible wire connected in series with the fusible ribbon.

22 Claims, 12 Drawing Figures

CURRENT LIMITING FUSE FOR CAPACITOR

BACKGROUND OF THE INVENTION

1. Field of the Invention:

The invention relates to electrical apparatus and, more particularly, to current limiting fusible devices.

2. Description of the Prior Art:

Fuse-protected capacitors are widely used in the transmission and distribution of electrical energy to provide power factor correction. Typical applications range from small single-capacitor installations to giant central generating station facilities having many banks of multiple capacitors. The high voltage stress placed upon these capacitors can occasionally cause breakdown of the capacitor insulation, resulting in a short circuit failure through the capacitor. If adequate protection is not provided, the capacitor case may then rupture and explode. Even when the individual capacitors are protected by fuses, the tremendous energy stored in parallel-connected capacitors will surge through the fuse of a failed capacitor causing the fuse to operate with a prominent audible and visual display attended by production of large volumes of ionized gases. This can then result in arcing to other installation structures, especially on indoor capacitor installations.

Where a large number of capacitors are present in a single installation, fault current resulting from the surge of energy from the capacitor bank through the failed capacitor has a very fast rise time in comparison with a normal 50 or 60 cycle current rise time. In other words, the fault current resulting from the dumping of capacitive energy through the failed capacitor has very high frequency components.

On smaller capacitor systems, on the other hand, the major fault current through a failed capacitor is likely to be 50 or 60 cycle current flowing from the line, rather than capacitive stored energy current. Protection of capacitors against the two types of fault currents to which they are susceptible requires different fault clearing characteristics. It is therefore desirable to provide a fuse having the capability to protect electrical systems from damage due to failed capacitors caused by both the high frequency capacitive fault current and the standard power line frequency fault currents.

In copending U.S. Pat. application Ser. No. 730,097, filed Oct. 6, 1976, by J. N. Santilli, there is disclosed a two-section fusible device having a current limiting portion to provide protection against high fault currents and an expulsion-type section to provide low current fault protection. It is desirable to provide an improved fusible device having a smaller visual and audible display upon operation. In addition, it is desirable to provide a more rugged fusible device in a smaller case which is particularly adapted to stand up to temperature cycling produced, for example, by high in-rush current.

Since proper fuse operation can result in a short circuited capacitor sustaining no visible damage, it is desirable that the fuse provide an indication of its operation so that periodic inspection of capacitor installations by maintenance personnel will result in the discovery of the failed unit. The large volume of hot ionized gases produced during operation of some prior art fuses has resulted in the need for mufflers or condensers to provide protection against arcing or flashover during fuse operation on an indoor or enclosed capacitor installation. These mufflers and condensers make it difficult to determine whether or not a fuse has operated. It is therefore desirable to provide a fusible device which minimizes the expulsion to the environment of hot ionized gases, thereby eliminating the need for mufflers or condensers and providing a more positive indication of operation.

SUMMARY OF THE INVENTION

In accordance with a preferred embodiment of the present invention, there is provided a fusible protective device incorporating a high-level current limiting section and a low-level expulsion-type fuse section. The two sections are connected in electrical series circuit relationship and, preferably, are mechanically attached. The current limiting section comprises a hollow tube of insulating material enclosed at each end by a metallic terminal cap. An interrupter rod of insulating material is coaxially mounted within the outer insulating tube and is secured at each end to the corresponding terminal member. A fusible element of corrugated conductive ribbon is helically wound about the interrupter rod and is electrically connected at each end to the corresponding terminal. The remaining volume within the interior of the insulating tube is packed with a suitable arc quenching material such as silica sand.

The expulsion fuse section comprises a hollow expulsion tube of insulating material surrounding and supporting a fusible link having a button-head terminal. The expulsion tube is lined with gas evolving material such as horn fiber to provide a narrow bore and includes a conductive metallic insert disposed between the interior of the gas evolving material and the fusible link, and extending beyond the ends of the fusible portion of the link. Means are provided to insulate the fuse link from the brass insert and form an air gap therebetween.

A standard spring and pigtail arrangement are provided with the expulsion fuse section so that upon separation of the fusible link, the lower terminal and pigtail will be drawn out of the interior of the insulating tube by the action of the spring.

The lower end of the expulsion fuse section has a small horn fiber bore which is more effective than the prior art larger bore. This smaller bore generates sufficient quantities of gas to cool the arc for proper interruption at low currents. Upon occurrence of a high level fault, the standard fusible link will immediately separate, and short arcs will form between the fuse link terminals and the metal insert across the air gap. These arcs will exist for only a short period of time since the current limiting section will operate to rapidly interrupt the flow of current through the entire device. The short arcs will generate only a small quantity of gas, thus preventing the large audible and visual displays characteristic of prior art devices under high fault conditions.

For indoor operation, a hollow gas-deflecting elbow member is mounted upon the open end of the low current section. Since only a small amount of gas will be evolved, this elbow is sufficient to deflect the evolved gas away from the critical areas of intense electric field and prevent flashover during operation on indoor capacitor installations. The disclosed construction eliminates the need for large mufflers or condensers, thereby permitting highly visible indication of fuse operation.

The construction and operation of the present invention will more readily become apparent upon reading the following specification taken in conjunction with the drawings.

DESCRIPTION OF THE PREFERRED EMBODIMENT

Figure 1:
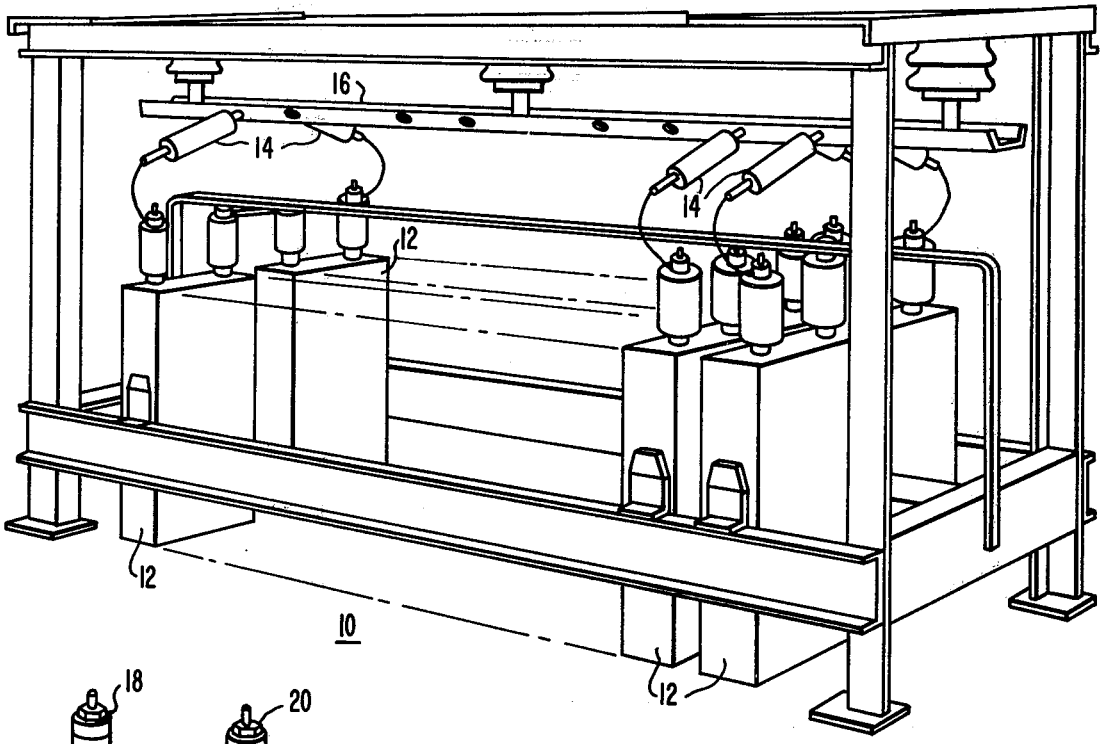
FIG. 1 is a perspective view of a conventional capacitor bank incorporating fusible devices according to the present invention.

Throughout the drawings, like reference characters refer to corresponding structural elements.

Open structural capacitor banks, commonly referred to as "stack-type" equipment, are the most economical means of obtaining large values of volt-amperes reactive (vars or kilovars) at potentials of 2400 volts up to the highest transmission voltages. Individual capacitor units are mounted and interconnected at the factory into a structural frame or stacking unit. Large banks are then assembled at field locations by bolting insulators and stacking units one on top of the other and electrically interconnecting the stacking units.

Selection of the capacitor unit voltage and var rating and the stacking unit size depends upon the system voltage, total bank required kilovars, and the manner of connection. For example, capacitor units rated 25, 50, 100, or 150 kilovars, and from 2400 to and exceeding 20,000 volts are arranged in series groups to match the system voltage, with sufficient numbers of units connected in parallel in each series group to provide the required total bank kilovar value.

Figure 2:
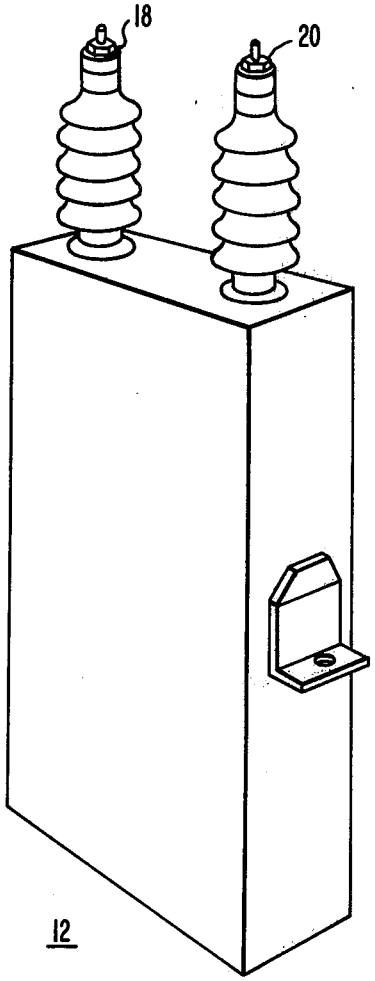
FIG. 2 is a perspective view of a single capacitor unit as employed in the capacitor bank of FIG. 1.
Figure 4:
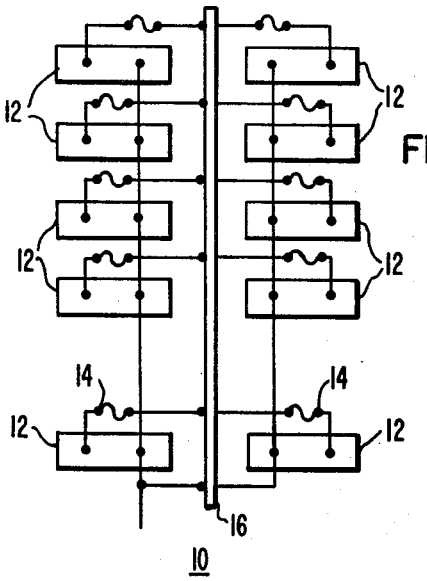
FIG. 4 is a schematic diagram showing the electrical connections of the capacitor bank and fusible devices of FIG. 1.

FIG. 1 shows a typical capacitor bank 10 comprising a plurality of capacitor units 12, each being connected through a fuse device 14 to a bus 16. The electrical connections of the bank 10 are shown more clearly in FIG. 4. FIG. 2 illustrates a typical two-terminal capacitor unit 12 with terminal insulators, or bushings, 18, 20.

Figure 3:
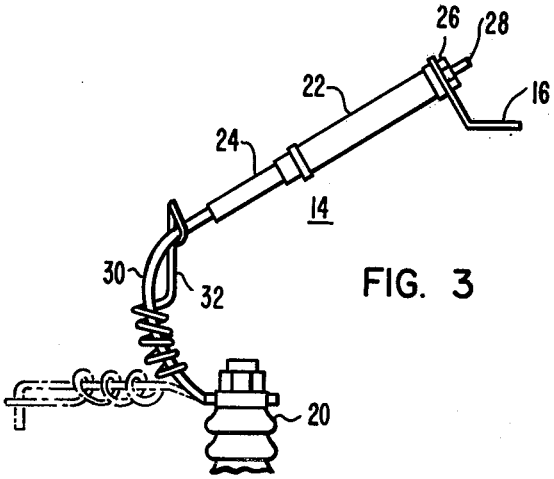
FIG. 3 is a side view of the fusible device incorporating the principles of the present invention, shown mounted between the central bus of the capacitor bank of FIG. 1 and one terminal of a single capacitor unit as shown in FIG. 2, with dotted lines indicating the observable blown condition of the fuse.

Each of the capacitor units 12 has a separate fusible device 14, shown most clearly in FIG. 3. The device 14 comprises a current limiting section 22 with a series connected expulsion fuse section 24 mechanically attached thereto. The device 14 is mechanically and electrically connected to the bus 16 by a nut 26 cooperating with a threaded stud 28 extending through a hole in the bus 16. A flexible conductor, or pigtail, 30 extends from the lower end of the expulsion fuse section 24 and is electrically attached to the capacitor bushing 20. Also attached to the bushing 20 is a spring 32 which encircles the pigtail 30, applying tension thereto. Upon operation of the expulsion fuse section 24 a fuse link 34 (shown more clearly in FIG. 5) electrically connected between the pigtail 30 and the current limiting section 22 will separate. The spring 32 will then pull the pigtail 30 and the lower section of the link 34 outward from the expulsion fuse section 24 to the position shown in dotted lines in FIG. 3. This provides positive indication of the operation of the device 14.

Figure 5:
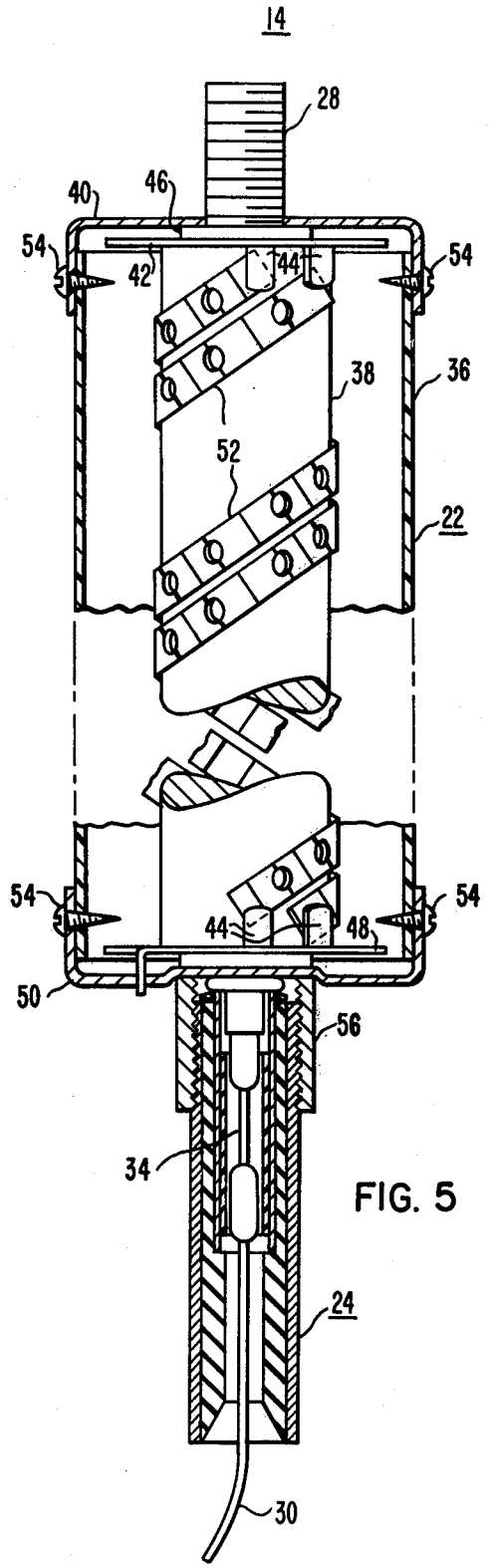
FIG. 5 is a sectional view of a two-section fusible device incorporating the principles of the present invention.

The construction of the fusible device 14 is shown more clearly in FIG. 5. A hollow insulating tube 36 encloses an insulating rod 38 of steatite or other suitable insulating material. The rod 38 is secured by epoxy adhesive to a thin metallic support member 42 having one or more bent-over tabs 44. The support member 42 is soldered to one side of a flange 46 of the threaded stud 28. The stud 28 is inserted through a hole in an upper cap or terminal 40 and is secured thereto by brazing the other side of the flange 46 to the inner surface of the terminal 40. The lower end of the rod 38 is epoxied to a lower metallic support member 48 also having one or more tabs 44. A portion of the member 48 extends through a small hole in a lower cap or terminal member 50 and is soldered thereto.

Figure 6:
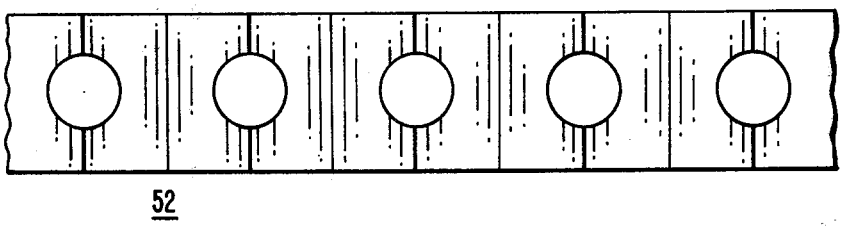
FIG. 6 is a detail elevational view of the corrugated conductive ribbon which is part of the current limiting section of the fusible device shown in FIG. 5.
Figure 7:
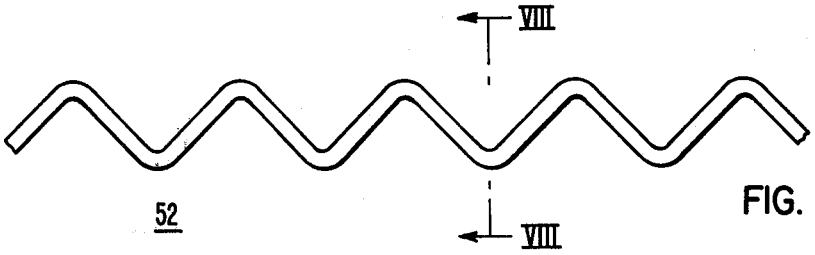
FIG. 7 is a side view of the corrugated conductive ribbon shown in FIG. 6.

One or more conductive fusible elements 52 are helically wound about the interrupting rod 38 and soldered to the tabs 44, thereby electrically connecting the upper and lower terminal caps 40 and 50. The fusible elements 52 are formed from a ribbon of silver or other suitable material. The elements 52 may be perforated with a series of holes as shown in FIG. 5, thereby producing favorable interruption characteristics as is well known in the art. It has been found that additional increase in interruption performance is obtained by forming corrugations, or ripples, in the ribbon 52, as is shown most clearly in FIG. 7. The perforations are centered at the peaks of the ripples, as is shown in FIGS. 6 and 7, and the ribbon wound about the rod 38 so that the perforations are not in contact with the rod 38. A small amount of tension is applied to the elements prior to soldering, so as to maintain positional stability on the rod 38.

Figure 8:
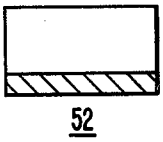
FIG. 8 is a cross section of the corrugated conductive ribbon shown in FIGS. 6 and 7.

The elements 52 have a cross section with a major and minor dimension, for example, a substantially rectangular cross section as shown in FIG. 8. As shown in FIGS. 6 and 7, the perforations of the ribbon element 52 substantially coincide with alternate ripples or bends in the element 52. While the specific dimensions of the element 52 will, of course, vary with the voltage and current rating of the particular device, the following dimensions, in inches, are typical:

Hole Spacing—0.297–0.344
Hole Diameter—0.123–0.127
Material Thickness—3.0 mil–7.0 mil
Material Width—0.250
Peak to Peak Thickness—0.070–0.080
Bend Radius—0.063–0.094

The remaining volume within the interior of the tube 36 is filled with a suitable arc quenching filler material such as silica sand. The sand is inserted into the interior of the tube 36, vibrated, and packed so as to completely fill the volume. Drive screws 54 are inserted through the caps 40 and 50 to secure them to the tube 36. Adhesive applied between the tube 36 and the lips of the caps 40 and 50 provides a suitable seal.

An interiorly threaded hollow ferrule 56 is brazed to the bottom terminal 50. An expulsion fuse section 24 is then threaded into the ferrule 56. The expulsion fuse section 24, shown most clearly in FIG. 9, comprises a hollow composite insulating tube 58 having a threaded outer diameter which is threaded into the ferrule 56. The tube 58 comprises an inner liner 60 of gas evolving material such as horn fiber and an outer sheath 62 of glass polyester. The inner liner 60 is bored out at its upper end to form a larger internal diameter portion having shoulders 64. A conductive cylindrical shunt, or insert, 66 of brass or other suitable material is seated in the larger bore against the shoulders 64. The insert 66 extends slightly above the end of the tube 58. Inserted into the shunt 66 is a standard fuse link 34 comprising a button head terminal 68, upper link terminal 70, fusible element 72, lower terminal 74, and the pigtail 30. Surrounding the fusible element 72 and partially surrounding the terminals 70 and 74 is an insulating paper tube 76, as is normally supplied with the fusible link. The tube 76 is, however, cut shorter than normal to provide air gaps 78 and 80 between the brass shunt 66 and the terminals 70, 74. The standard fuse link 34 including the button head 68, terminals 70 and 74, fusible element 72, and tube 76, is replaceable.

A spring washer 67 is seated around the button head terminal 68 between the flange of the terminal 68 and the upper end of the liner 60. When the tube 58 is tightly screwed into the ferrule 56, the spring washer 67 insures that the button head terminal 68 will make solid electrical contact with the lower terminal 50 of the current limiting section 22.

Figure 9:
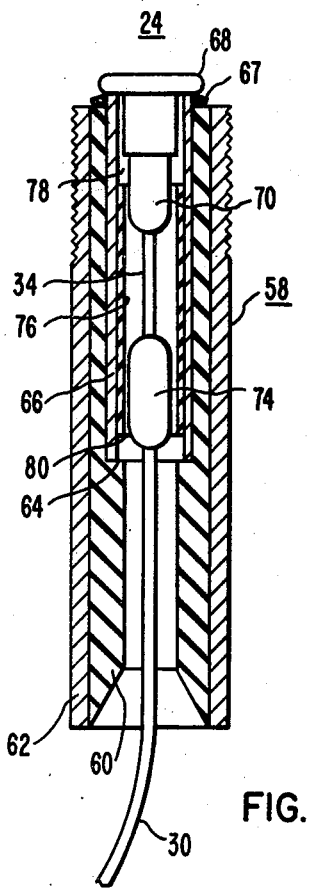
FIG. 9 is a detail sectional view of the expulsion fuse portion of the fusible device shown in FIG. 5.

In operation, the fusible element 72 will melt and separate upon occurrence of a low current fault of, for example, 200 amperes, causing an arc to be drawn between the separated portions of the element 72. The action of the spring 32 upon the pigtail 30 will cause the lower terminal 74 and its associated element end to be drawn downward out of the tube 58 as seen in FIG. 9. Since the shunt 66 is electrically connected to the upper terminal 68, the arc will transfer to the shunt. Only when the lower element end is drawn out of the shunt will the established arc impinge upon the surface of the fiber liner 60. At this time, quantities of gas will be evolved to extinguish the established arc. For the relatively low fault currents for which the section 24 is designed to operate, the quantity of evolved gas will not be large. However, due to the reduced inner diameter at the bottom of the liner 60, the gas pressure (produced by the action of the arc upon the liner 60 as the lower terminal is drawn therethrough) will be sufficiently high to extinguish the arc. The time interval between ignition and extinction of the arc is acceptable at the low fault currents for which the section 24 is designed to operate.

When faults of greater magnitude occur, for example 10,000 amperes, the element 34 is almost instantaneously vaporized causing an arc to be rapidly established across the gap 80. In addition, a potential difference may be established between the shunt 66 and the button head 68 causing a small intense arc to be established across the air gap 78. Only a minimal amount of gas will be evolved under these conditions. In the meantime, however, the ribbon 52 of the current limiting section 22 will be operating to limit the current passed by the device 14 to a value below the available fault current. The operation of the current limiting section 22 insures that the fault will rapidly be cleared before the lower end of the element 72 is drawn below the lower end of the brass insert 66. Thus, the arc in the section 24, although intense, remains short during its existence and will not impinge upon lower surfaces of the liner 60 and will not evolve excessive quantities of gas. The combined action of evolved gas and the spring 32 insure that the terminal 74 and pigtail 30 will be expelled from the bottom of the low current section 24 to the position shown in dotted lines of FIGS. 3, thereby providing a positive indication of fuse operation.

Figure 11:
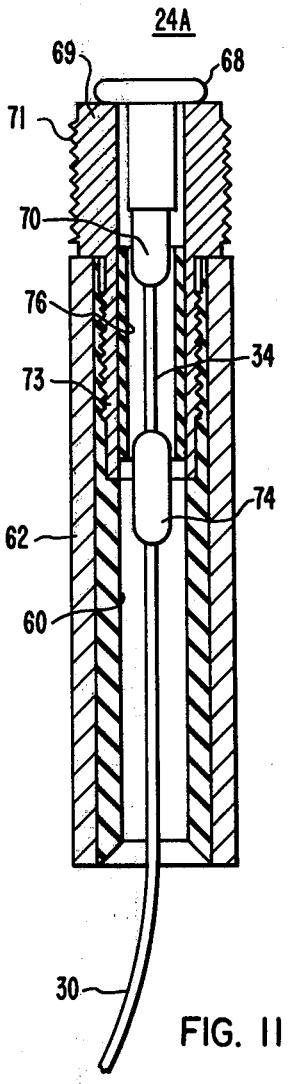
FIG. 11 is a detail sectional view of the expulsion fuse portion of another alternative embodiment of the invention.

The expulsion fuse portion 24A of an alternative embodiment of the invention is shown in FIG. 11. A brass fitting 69 having threaded portions 71 and 73 eliminates the need for the washer 67. The paper tube 76 still provides insulation between the brass fitting 69 and the fusible element 72 and establishes an air gap between the fitting 69 and lower terminal 74. The paper tube 76 could be replaced (both here and in the preferred embodiment) by other insulating means which would prevent shunting of the fusible element 72 during normal operation, yet allow an arc to be established between the brass insert 66 (or fitting 69) and the lower fuse terminal 74 after separation of the element 72 during overload conditions.

By providing the current limiting section 22 with a corrugated ribbon 52 rather than the flat ribbon of prior art current limiting fuses, several advantages are obtained. There is an increase in interrupting current withstand ability which allows a device incorporating the present invention to provide protection under situations where prior art fuses would explode or fail. While the mechanism producing this increase in performance is not fully understood, it is believed that a magnetic blow-off effect may occur since the curved portions of the ribbon 52 act as partial turns, locally increasing the magnetic field and the magneto-dynamic force produced under high current conditions. In addition, by providing a rippled or wavy ribbon, a 20% increase in effective length can be obtained beyond that obtainable for an equivalent end-to-end length of flat ribbon. This allows an increased turn-to-turn spacing on the insulating rod 38.

Migration of sand particles behind the ribbon of prior art fuses sometimes resulted in premature failure caused by ribbon breakage due to temperature cycling. However, the resilience produced by the spring action of the rippled ribbon of the present invention will withstand greater stress from temperature cycling without breakage. The spring characteristics of the rippled ribbon also prevent the ribbon from moving after being wound upon the rod 38. Such movement of the prior art flat ribbons sometimes results in failure due to changes in the turn-to-turn spacing. Furthermore, the rippled ribbon exhibits less tendency to cascade; i.e., the tendency of an arc to jump from one perforation to another. This is because the waviness of the ribbon displaces the reduced cross section areas of adjacent ribbon turns.

Figure 10:
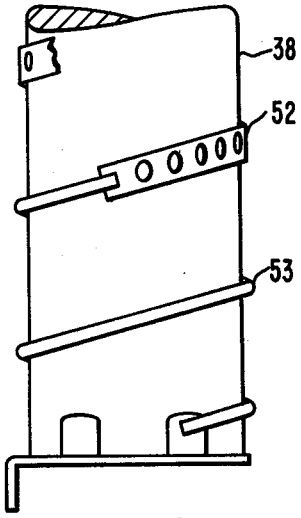
FIG. 10 is a detail side elevational view of the current limiting section of an alternate embodiment of the invention.

In FIG. 10 there is shown an alternate embodiment of the invention particularly suited for very large high current, high voltage installations. A supplemental fusible element 53 having a circular cross section is electrically connected in series with the corrugated ribbon 52 wound upon the insulating rod 38. The element 53 may be of copper, silver, or other suitable conductive fusible material. The tremendous amounts of energy present when large values of capacitance are subjected to ultra high voltages such as are present on modern transmission lines generate high frequency fault currents of very large magnitude. It has been found that the combination of the ribbon element 52 and the circular cross-sectioned element 53 produces superior interrupting performance where large numbers of capacitors having a high kilovar rating are employed. Although standard flat ribbon elements 52 could be used in the series combination, it is preferred that the ribbon 52 be of the rippled configuration as taught by the present invention.

Figure 12:
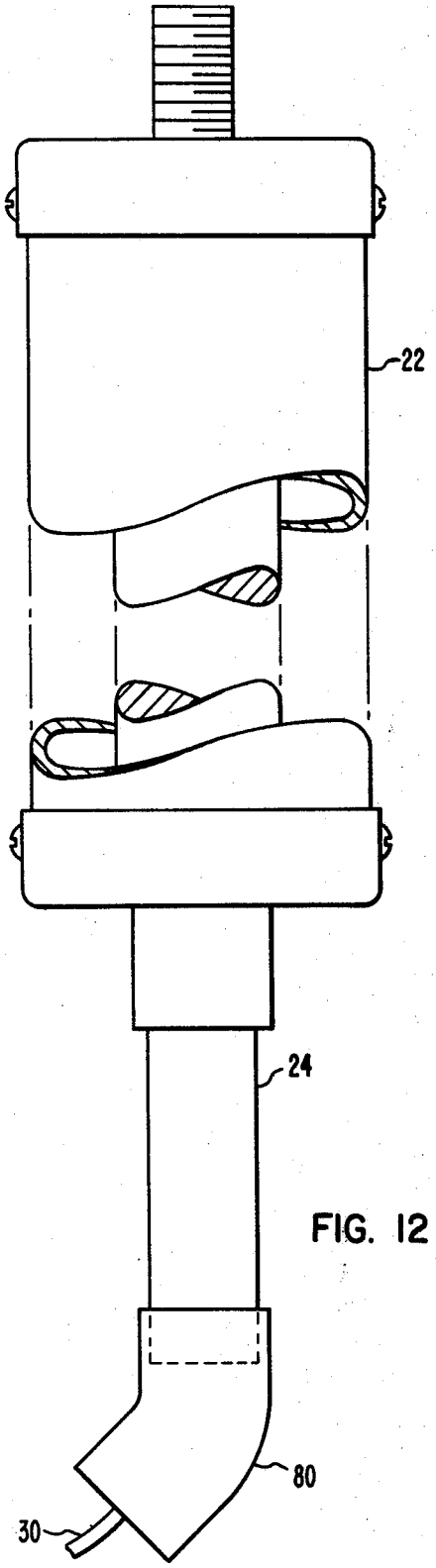
FIG. 12 is a side elevational view of the fusible device shown in FIG. 5, with the gas deflector elbow attached for use in enclosed capacitor installations.

As discussed previously, the expulsion section 24 minimizes the amount of gas evolved under high fault conditions. The coordination of the expulsion section 24 with the current limiting section 22 provides a device 14 which protects over a wide range of possible fault currents with a minimal amount of evolved gas. Thus, the condensers or mufflers or prior art devices are not required. For interior or enclosed capacitor installations, a simple gas deflecting elbow member 80 is employed as shown in FIG. 12. This permits the small amount of gas which is evolved during operation of the device 14 to be directed away from areas of high electric field concentration. The member 80 is sufficient to prevent arcing or flashover within the confined volume of interior or enclosed capacitors and thus provides adequate protection without interfering with the indication function of the spring and pigtail combination, as was the case with prior art devices employing mufflers or condensers.

From the foregoing, it can be seen that the present invention provides an improved fusible device particularly suited to providing protection for capacitor installations over a wide range of possible fault currents.

I claim:

1. A current limiting fusible protective device comprising:

a current limiting fuse section adapted for interruption of high fault currents and comprising a fusible ribbon of conductive material having a cross section with major and minor dimensions, and a fusible conductive wire having a substantially circular cross section; and a low current expulsion fuse section adapted for interruption of relatively low fault currents and comprising a replaceable fusible conductive link;

said fusible ribbon, said fusible wire, and said fusible link being electrically connected in series circuit relationship.

2. A device as recited in claim 1 wherein said fusible ribbon comprises corrugated rectangularly cross-sectioned conductive ribbon.

3. A device as recited in claim 2 wherein said current limiting fuse section comprises an insulating housing enclosing said fusible ribbon and said fusible wire, and arc-quenching filler material surrounding said fusible ribbon and fusible wire and occupying the remaining volume defined by said housing.

4. A device as recited in claim 3 wherein said current limiting fuse section comprises an insulating support rod located within said housing, and wherein said fusible ribbon and said fusible wire are helically wound about said support rod.

5. A current limiting fusible protective device comprising:

a current limiting fuse section adapted for interruption of high fault currents; and an expulsion fuse section adapted for interruption of relatively low fault currents and electrically connected in series with said current limiting section; said expulsion fuse section comprising an insulating tube, a section terminal attached to one end of said tube and electrically connected to said current limiting section, an expellable terminal adapted for electrical connection to associated equipment, a fusible link disposed within said tube and electrically connected between said section terminal and said expellable terminal, gas evolving material disposed within the interior of said tube, and a shunt of conductive material surrounding said fusible element and disposed between said fusible element and said gas evolving material.

6. A device as recited in claim 5 wherein said shunt extends the entire length of said fusible element.

7. A device as recited in claim 5 comprising an insulating non-gas evolving tube surrounding said fusible element and disposed between said fusible element and said shunt.

8. A device as recited in claim 7 wherein said shunt extends the entire length of said fusible element.

9. A device as recited in claim 5 wherein said gas evolving material comprises a cylindrical tube having a first portion having a relatively large bore in which said fusible link is disposed and a second portion having a smaller bore through which said expellable terminal extends.

10. A device as recited in claim 9 wherein said shunt is electrically connected to said section terminal and forms an air gap with one end of said fusible link.

11. A device as cited in claim 5 comprising means disposed between said shunt and said fusible element for providing insulation therebetween during normal current flow, said shunt being electrically annealed to said section terminal, said insulating means being disposed and constituted so as to permit an arc to be established between said shunt and the portion of said fusible link including said expellable terminal upon separation of said fusible link during overcurrent conditions.

12. A device as recited in claim 11 wherein said insulating means resistance is of a value sufficient to isolate said shunt from said fusible element and expellable terminal during normal current flow, and to break down during overcurrent conditions under which said fusible element fuses, thereby allowing an arc to be established through said insulating means.

13. A device as recited in claim 11 wherein said insulating means is positioned so as to form an air gap between said shunt and said expellable terminal, said gap having a resistance value so as to isolate said shunt and said expellable terminal during normal current flow and to break down during overcurrent conditions which are sufficient to fuse said fusible link.

14. A current limiting fusible protective device, comprising:

a hollow insulating housing;

a pair of electrical terminals mounted upon said housing and adapted for electrical series connection with apparatus to be protected; and a fusible member of corrugated conductive material disposed within said housing and electrically connected between said terminals, said fusible member being formed into a helix and having corrugations regularly spaced along the length thereof.

15. A device as recited in claim 14 wherein said fusible member is formed from conductive material having a cross section with major and minor dimensions, and said fusible member is wound into a helix with said minor cross sectional dimension being substantially perpendicular to the axis of said helix.

16. A device as recited in claim 15 wherein said fusible member comprises a plurality of locations along its length having a reduced total cross sectional area.

17. A device as recited in claim 16 wherein the locations of reduced cross sectional area are regularly spaced and centered upon alternate corrugations.

18. A device as recited in claim 17 wherein said locations of reduced cross sectional area comprise perforations.

19. A device as recited in claim 17 comprising an insulating support and, said fusible member being wound into a helix about said support rod.

20. A device as recited in claim 16 comprising an insulating support and, said fusible member being wound into a helix about said support rod.

21. A device as recited in claim 15 comprising an insulating support and, said fusible member being wound into a helix about said support rod.

22. A device as recited in claim 14 comprising an insulating support and, said fusible member being wound into a helix about said support rod.

* * * * *